US007064732B2

(12) United States Patent
Van Der Broeck et al.

(10) Patent No.: US 7,064,732 B2
(45) Date of Patent: Jun. 20, 2006

(54) METHOD OF CONTROLLING A CIRCUIT ARRANGEMENT FOR THE AC POWER SUPPLY OF A PLASMA DISPLAY PANEL

(75) Inventors: Heinz Van Der Broeck, Zülpich (DE); Matthias Wendt, Würselen (DE); Hans Steinbusch, Landgraaf (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/500,760

(22) PCT Filed: Dec. 23, 2002

(86) PCT No.: PCT/IB02/05598

§ 371 (c)(1),
(2), (4) Date: Jul. 6, 2004

(87) PCT Pub. No.: WO03/058591

PCT Pub. Date: Jul. 17, 2003

(65) Prior Publication Data

US 2005/0029956 A1 Feb. 10, 2005

(30) Foreign Application Priority Data

Jan. 11, 2002 (DE) ..... 102 00 827

(51) Int. Cl.
*G09G 3/28* (2006.01)

(52) U.S. Cl. ..... 345/60; 345/63; 345/76; 345/77

(58) Field of Classification Search ..... 345/55, 345/60, 66–70; 323/272, 271, 282, 235, 323/239, 259, 267, 269, 319, 344; 315/209 R, 315/224, 225, 246, 247

See application file for complete search history.

(56) References Cited

U.S. PATENT DOCUMENTS

| | | | | |
|---|---|---|---|---|
| 6,897,834 | B1 * | 5/2005 | McCormack | 345/55 |
| 2002/0030642 | A1 * | 3/2002 | Huang et al. | 345/60 |
| 2002/0033806 | A1 * | 3/2002 | Vossen et al. | 345/204 |
| 2002/0047577 | A1 * | 4/2002 | Roh et al. | 315/169.3 |
| 2002/0121862 | A1 * | 9/2002 | Schoenbauer et al. | 315/169.3 |

* cited by examiner

*Primary Examiner*—Tuyet Thi Vo

(57) ABSTRACT

A method of controlling a circuit arrangement for an AC voltage supply of a plasma display panel, the circuit arrangement comprising at least a transistor bridge constituted by the bridge transistors (T1, T2, T3, T4), an input voltage (U0), a capacitor (Cp) of the plasma cell and a charging circuit comprising an auxiliary voltage (Uh), a first auxiliary transistor (T11) and a first coil (L1) and at the beginning of the charging operation the first auxiliary transistor (T11) is turned on, characterized in that once the first auxiliary transistor (T11) has been turned on, the second bridge transistor (T2) of the half bridge continues to be turned on for a delay time tv and is turned off after the delay time tv has elapsed.

17 Claims, 5 Drawing Sheets

METHOD OF CONTROLLING A CIRCUIT ARRANGEMENT FOR THE AC POWER SUPPLY OF A PLASMA DISPLAY PANEL

This application is the national phase under 35 U.S.C. § 371 of PCT International Application No. PCT/IB02/05598 which has an International filing date of Dec. 23, 2002, which designated the United States of America and which claims priority on German Patent Application number 102 00 827.2 filed Jan. 11, 2002, the entire contents of which are hereby incorporated herein by reference.

BACKGROUND OF THE INVENTION

The invention relates to a method of controlling a circuit arrangement for an AC voltage supply of a plasma display panel (PDP), more particularly a sustain driver. PDPs are flat picture screens or televisions which are produced with the aid of plasma technology. Light is then generated by small gas discharges between two glass plates. In principle, small, individual plasma discharge lamps are driven via electrodes arranged horizontally and vertically. Considerable electronic circuitry is necessary for operating the plasma cells. The so-called sustain driver whose task is to supply trapezoidal AC voltages to the self-capacitances of the plasma cells takes up the largest surface area. The electrodes of the plasma cells are then connected to the outputs of two half bridges of a commutation circuit. The two outputs of the half bridges may apply the positive input voltage +U0, the negative input voltage −U0 or the zero voltage (short-circuit of the electrode terminals) to the electrodes of the plasma cells. The two half bridges are supplied with an auxiliary voltage which corresponds to 50% of the input voltage U0. For the cells to be ignited, a rapid change from the positive to the negative voltage and vice versa is to take place on the electrodes. For this purpose, the voltage output of a half bridge converter is alternately connected to the positive voltage pole, whereas the other voltage output is applied to the minus pole. In so far as the two transitions are directly consecutive, the voltage on the plasma cells changes very rapidly from a negative to a positive value of the input voltage U0. As a result, the cells are ignited. To avoid losses which arise during the direct charging and discharging of the capacitor of the plasma cell, the sustain driver is usually structured as a resonant switched-mode power supply in which the charging and discharging of the capacitor of the plasma cell takes place free of losses in principle. When this principle of resonance is realized and converted, the oscillation is attenuated because the coils, supply lines and semiconductor switches represent parasitic resistances. This leads to the fact that the voltage on the plasma cell does not completely jump to the input voltage or zero, respectively. In consequence, the bridge transistors are included in the circuit leading to the development of a loss-affected recharging or residual discharge. The currents linked with this are flowing with each recharging even when the plasma cells should not light up. The loss-affected recharging or residual discharge further causes problems with respect to the electromagnetic compatibility (EMV). The influence of the parasitic resistances is noticeable as a characteristic stage in the oscillation curve of the plasma voltage. Once the charging current for the capacitor of the plasma cell has reached its output value, thus substantially zero, the characteristic stage appears in the oscillation curve (here: jump from "substantially zero" to "zero" in the oscillation curve. Before the oscillation operation the two transistors of the half bridge are turned off so that a change of the voltage on the capacitor of the plasma cell can take place).

This known symmetrical commutation circuit can be easily manufactured as regards the circuitry. Therefore, it is an object of the invention to provide a method of controlling a circuit arrangement for the AC power supply to a plasma display panel which leads to a compensation of the losses caused by the parasitic resistances and to a reduction of the electromagnetic interference.

SUMMARY OF THE INVENTION

The object is achieved, on the one hand, in that at the moment when the first auxiliary transistor T11 is turned on, thus at the beginning of the charging operation of the capacitor (Cp), the first bridge transistor T1 of the half bridge is turned off and the second bridge transistor T2 of the half bridge continues to be turned on for a predefined delay time and is turned off after the delay time tv has elapsed. As a result the cell voltage Up first remains equal to zero (Up=0). Meanwhile, the charging current i1(t) linearly increases in the first coil L1. The moment the second bridge transistor T2 is turned off, the resonant charging operation of the capacitor Cp of the plasma cell commences. Since the current of the plasma cell is now equal to the charging current i1, it already has an initial value when the capacitor Cp is rendered conductive, so that the capacitor Cp is charged more rapidly. When the time tv of the delayed turn-off is adapted and the first coil L1 is pre-charged in an adapted fashion, the capacitor Cp will be completely charged from zero to the input voltage U0 within the next half sine-wave oscillation.

The object of the invention will also be achieved in that at the moment when the second auxiliary transistor T12 is turned on, thus at the beginning of the discharge operation of the capacitor Cp, the second bridge transistor T2 of the half bridge is turned off and the first bridge transistor T1 of the half bridge continues to be turned on for a predefined delay time and is turned off after the delay time tv has elapsed. As a result, the charging current i2(t) in the second coil L2 increases linearly. At the moment when the first bridge transistor T1 is turned off; the resonant discharge operation of the capacitor Cp of the plasma cell commences and is terminated when the half sine-wave oscillation (Up=0) has ended.

BRIEF DESCRIPTION OF THE DRAWINGS

For reasons of symmetry the current balance on the capacitor Cs is compensated (Us=U0/2) according to the invented method of controlling a charging and discharging operation. An embodiment of the circuit arrangement according to the invention will be further explained with reference to the following Figures, in which according to the state of the art is shown in FIG. 1 the transistor bridge for generating a cell voltage with a conventional commutation circuit (for clarity only the commutation circuit of a half bridge is shown).

Figure 3:
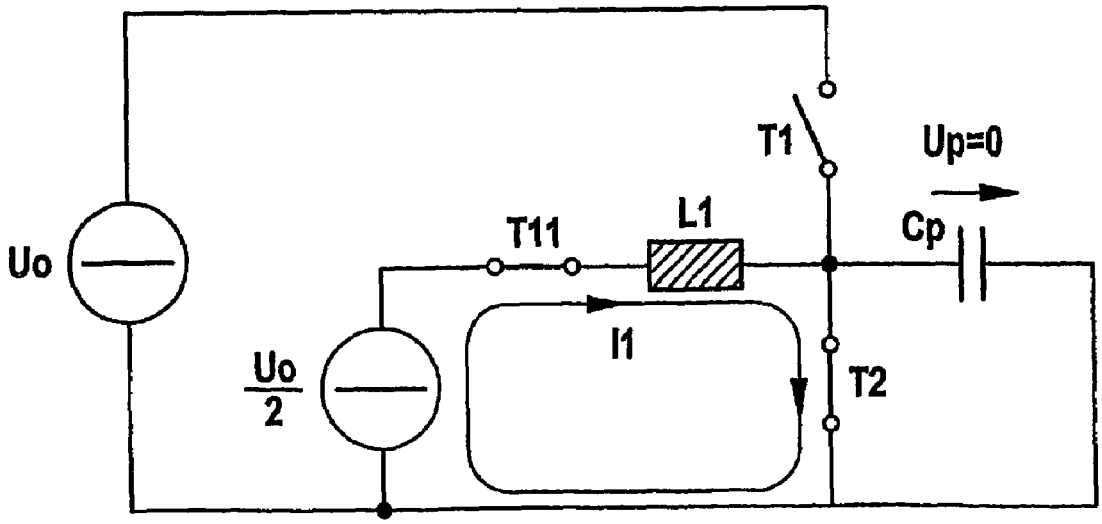
Figure 4:
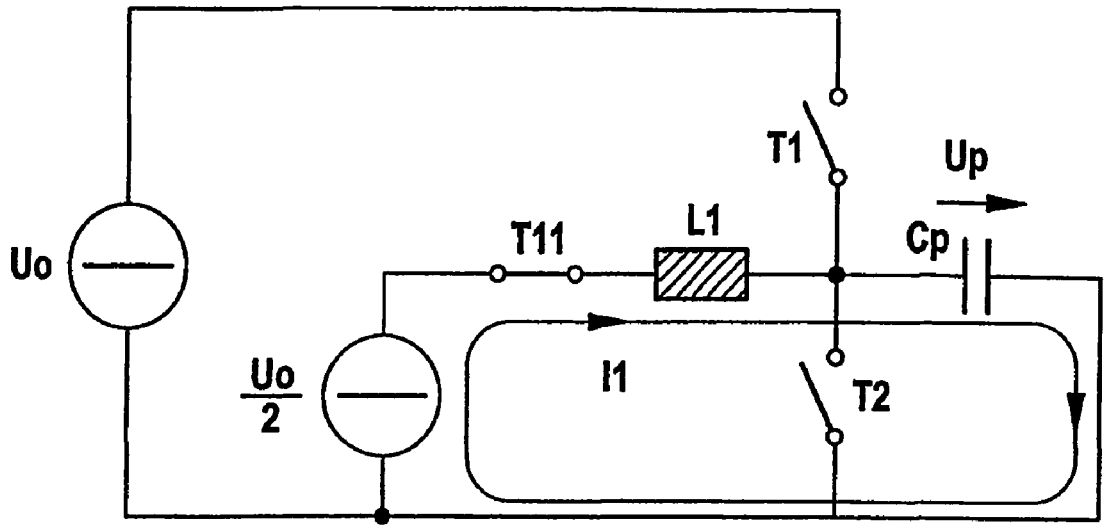
Figure 5:
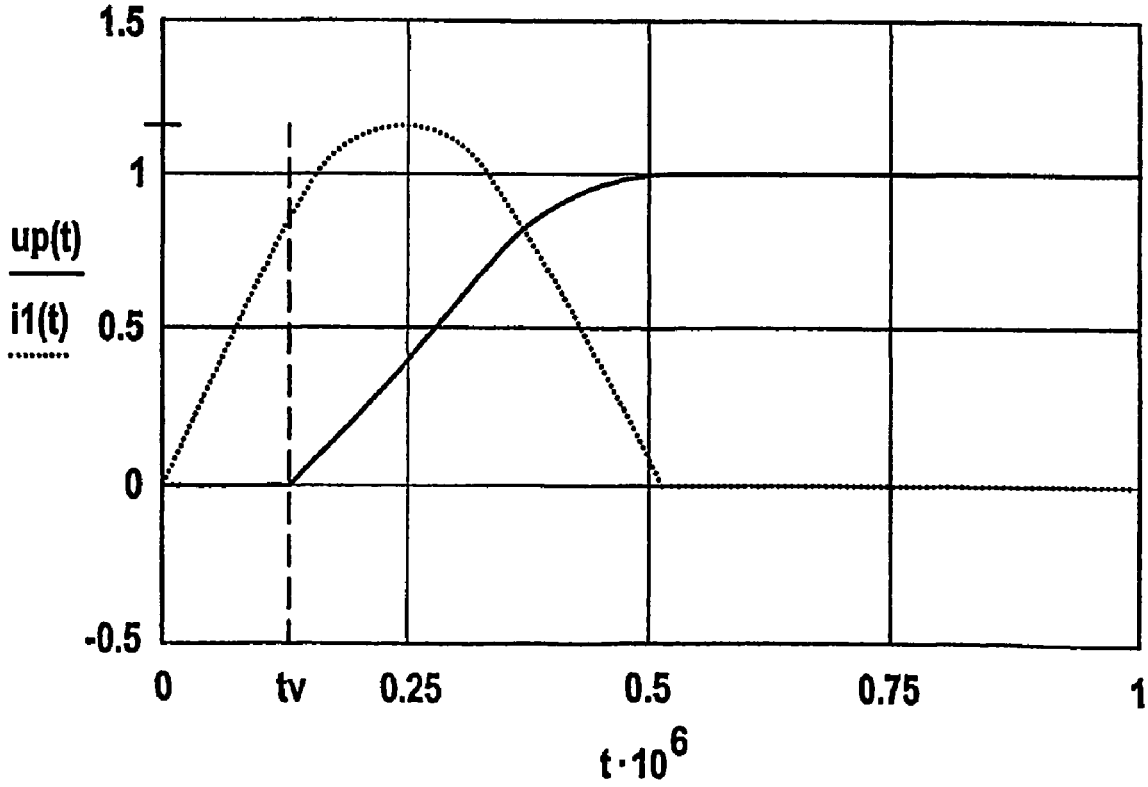
Figure 6:
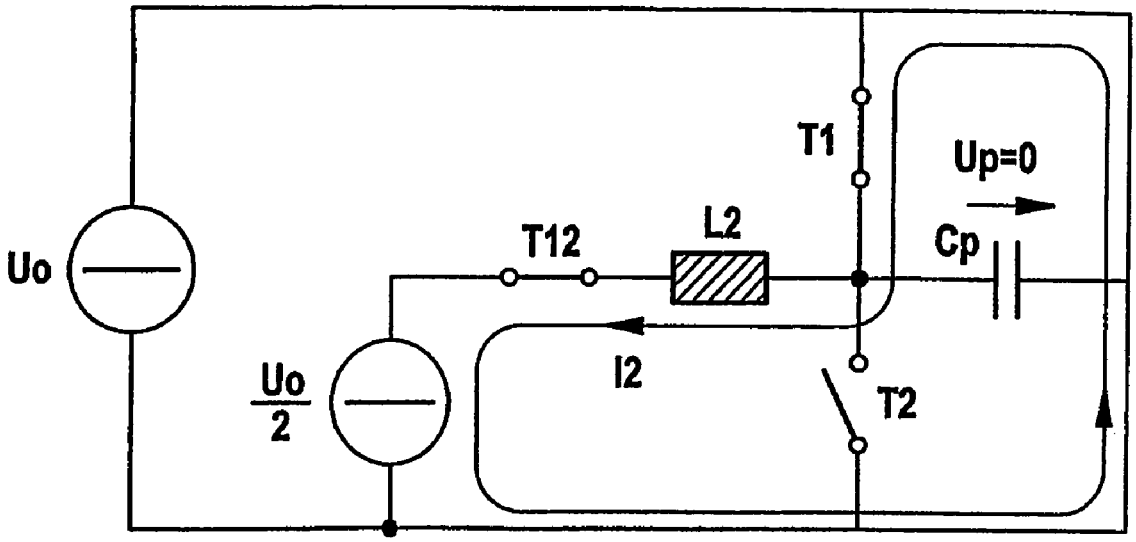
Figure 7:
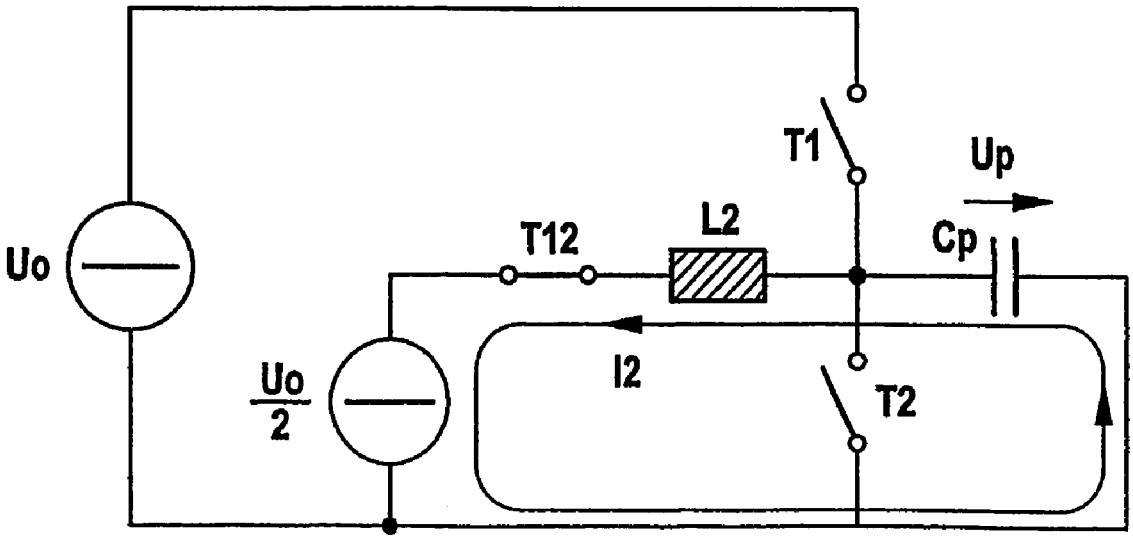
Figure 8:
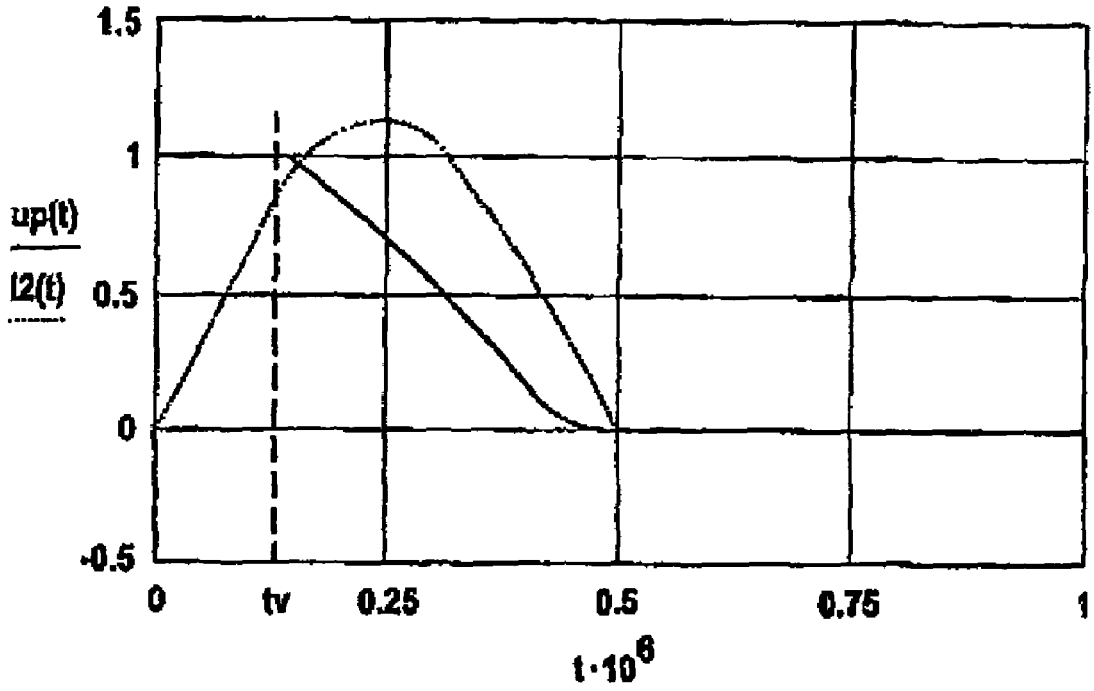

The invention further shows in:

FIG. 3 the position of the essential elements of the commutation circuit during the charging operation for an instant t<tv;

FIG. 4 the position of the essential elements of the commutation circuit during the charging operation for an instant t>tv;

FIG. 5 a diagram showing the charging operation of the capacitor Cp of the plasma cell with a compensation of the influence of the parasitic resistances;

FIG. 6 the position of the essential elements of the commutation circuit during the discharging operation for an instant t<tv;

FIG. 7 the position of the essential elements of the commutation circuit during the discharging operation for an instant t>tv; and FIG. 8 a diagram of a discharging operation of the capacitor Cp of the plasma cell with a compensation of the influence of the parasitic resistances.

Figure 9:
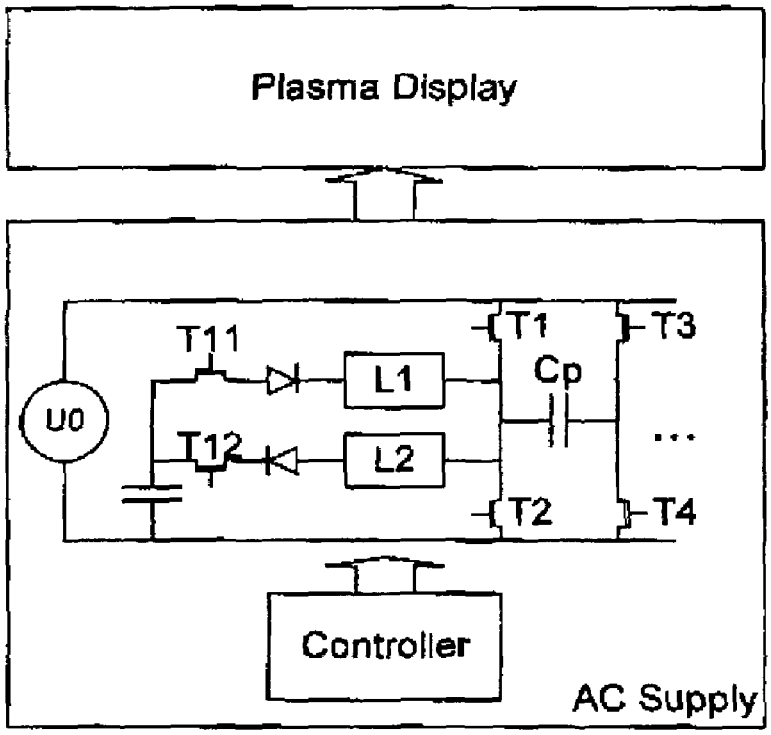

FIG. 9 illustrates an example plasma display system.

DETAILED DESCRIPTION OF THE PREFERRED EMBODIMENT

Figure 1:
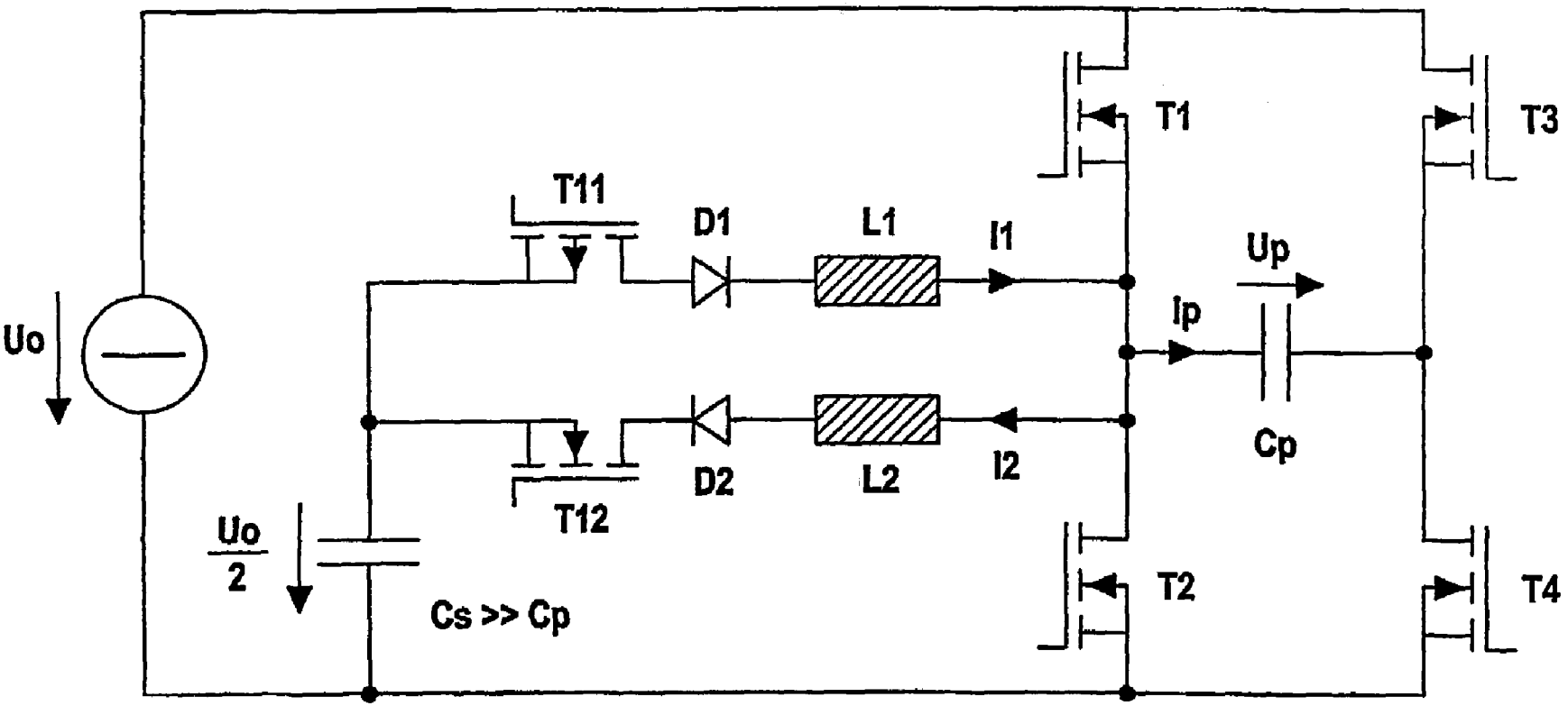
prior art FIG. 1

The transistor bridge shown in FIG. 1 with a conventional commutation circuit in essence comprises two half bridges. The electrodes of the plasma cells are connected to its outputs. Depending on the drive of the bridge transistors T1, T2, T3 and T4 the positive input voltage Up=+U0, the negative input voltage Up=U0, or the zero voltage Up=0 (short-circuit of the electrode terminals) is present on the outputs of the two half bridges. For the plasma cells to ignite, there must be a rapid change from the positive to the negative voltage and vice versa. For this purpose, the voltage output of a half bridge converter is alternately applied to the positive voltage pole, while the respective other voltage output is applied to the negative voltage pole. In so far as the two transitions directly follow each other, the voltage on the plasma cells very rapidly changes from the negative to the positive value of the input voltage U0. This causes the plasma cells to be ignited in so far as additionally an addressing is made. The ignition current for light generation then flows via the diagonal first and fourth transistors T1 and T4 or T2 and T3 of the bridge circuit. Each half bridge comprises an oscillation circuit with FIG. 1 only showing one half bridge. The single oscillation circuit comprises a capacitor Cp of the plasma cell and the inductance L1 for the charging operation and L2 for the discharging operation. The charging operation is initiated by means of an auxiliary transistor T11 which is connected in series to the inductance L1 and the discharging operation is initiated by the auxiliary transistor T12 which is connected in series to the inductance L2. The diodes D1 and D2 arranged between the auxiliary transistors T11, T12 and the inductances provide that each time only one charging or discharging current occurs in a semi-oscillation. In a symmetrical arrangement and drive of the commutation circuit the half input voltage U0 appears on the capacitor Cs substantially as an auxiliary voltage Uh, which means Uh=U0/2. The capacitor Cs is then selected so large that there is no change of the capacitor voltage on the capacitor Cs, i.e. Cs>>Cp within one switching period. If now the empty capacitor Cp of the plasma cells is connected to the capacitor Cs charged with the auxiliary voltage Uh via the auxiliary transistor T11 used as a switch, an oscillation operation will arise which is limited to a sine oscillation of the charging current I1. The termination after a half period is effected by the diode D1 in the circuit that allows only the positive wave. At the same time, together with the sine oscillation of the charging current I1, a cosine-shaped cell voltage Up builds up on the capacitor Cp of the plasma cell, which cell voltage Up rises from zero to approximately double the value of the auxiliary voltage Uh on the capacitor Cs, which approximately corresponds to the input voltage U0. As a result of the parasitic resistances determined by the coils, supply lines and semiconductor circuit, the voltage Up, however, is attenuated and does not reach the value of the input voltage U0 during the charging operation.

The discharging of the capacitor Cp of the plasma cell with the aid of the oscillation circuit comprising the capacitor Cp and the inductance L2 is effected only substantially free of losses because of the parasitic resistances. In this case the oscillation operation is initiated when the second auxiliary transistor T12 is turned on.

Figure 2:
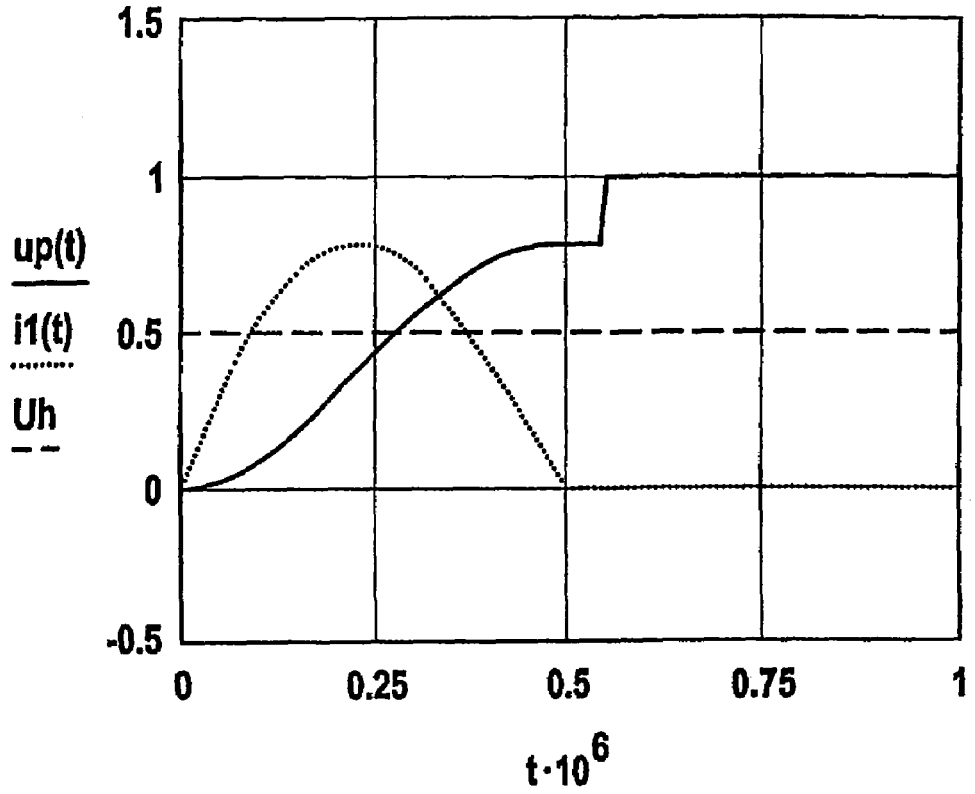
FIG.2 prior art
FIG. 2 shows the influence of the parasitic resistances on the cell voltage Up of the capacitor Cp of the plasma cell.

After the oscillation operation has ended, either the upper or the lower bridge transistor of the half bridge (T1, T2) is turned on. Since the cell voltage Up on the capacitor Cp of the plasma cell has not reached the value of the input voltage U0 as a result of the attenuated oscillation, the recharging current Ip will flow when the half bridge T1 is turned on. The jump from Up to U0 of the maximum voltage that can be reached during the charging operation at the switch-on time of the bridge transistor T1 is shown in FIG. 2. The normalized representation of the influence of the parasitic resistances during the charging operation in FIG. 2 is related to the input voltage U0 as regards the cell voltage Up and as regards the charging current I1 to the input voltage U0 divided by the impedance Z0, where Z0 is formed by $$Z0 = \sqrt{\frac{L0}{Cp}}$$

The recharging shown in FIG. 2 as a jump in the voltage curve is a residual discharge during the discharging operation. The cell voltage Up then reaches the zero value only substantially. The jump to zero takes place when the transistor T2 is turned on. The inherent currents are flowing with each oscillation even when the plasma cells should not light up. The recharging or residual discharging causes additional losses and problems with the electromagnetic compatibility (EMV).

FIG. 3 shows the position of the essential circuit elements for the instant t<tv. When the first auxiliary transistor T11 is turned on, thus at the beginning of the charging operation of the capacitor Cp, the first bridge transistor T1 of the half bridge is turned off, the bridge transistor T1 in FIG. 3 is shown as an open switch. The second bridge transistor T2 of the half bridge continues to be turned on for a predefined delay time. With the conventional method of controlling the commutation circuit the two bridge transistors (T1, T2) of the half bridge are turned off prior to each oscillatory operation i.e. prior to one of the auxiliary capacitors T1 and T2 being switched on and the flowing of the charging or discharging current, because otherwise no change of the cell voltage Up takes place at the capacitor Cp. According to the method according to the invention the current circuit comprises an auxiliary voltage Uh for the instant t<tv, which auxiliary voltage Uh is about half the input voltage U0 and is present at the capacitor Cs, comprises the first auxiliary transistor T11, the first coil L1 and comprises the bridge transistor T2. The cell voltage Up continues to be zero because the capacitor Cp does not build up any capacitance.

FIG. 4 shows the position of the essential circuit elements in accordance with the method according to the invention of controlling a circuit arrangement for supplying the AC voltage to a plasma display panel for the instant t>tv. The second bridge transistor T2 is shown as an open and thus currentless switch. The circuit thus comprises for t>tv the capacitor Cs which is here shown as a voltage source having 50% of the value of the input voltage Uh=U0/2, the first auxiliary transistor T11, the first coil L1 and the capacitor Cp.

FIG. 5 is a diagram showing the charging current and the cell voltage over time t The current linearly rises with time t<tv. This is caused by the conducting switch T2 for t<tv. For t>tv the rise in voltage is steeper than with the conventional method of the commutation circuit control, because the charging current i1(t) in the first coil L1 has already been partly built up. Since the capacitor Cp is charged from t>tv onwards, the voltage difference across the first coil L1 diminishes and thus also the rise in voltage. The charging current i1 then according to the invention reaches a maximum current i1max which exceeds the maximum current in FIG. 2 of the state of the art. As a result, the capacitor Cp is charged to a higher voltage up(t) during the sinusoidal half oscillation of the charging current i1(t).

The described method according to the invention ensures that at the end of the charging operation the cell voltage UP at the capacitor Cp has reached the value of the input voltage U0. As a result, the transistor T1 of the half bridge is turned on voltage-free and less high-frequency interference and losses will arise.

The object is also achieved, however, by a method according to the invention in which it is ensured that at the end of the discharging operation the cell voltage Up on the capacitor Cp has substantially reached the zero value and the second bridge transistor T2 of the main bridge is turned on voltage-free.

FIG. 6 shows the position of the essential elements of the commutation circuit at the discharging operation for an instant t<tv. By turning on the second auxiliary transistor T12, thus at the beginning of the discharging operation of the capacitor Cp, the second bridge transistor T2 of the half bridge is turned off; in FIG. 6 the second bridge transistor T2 is shown as an open switch. The first bridge transistor T1 of the half bridge continues to be turned on for a predefined delay time tv. In accordance with the invented method of discharging the circuit comprises an auxiliary voltage Uh for the instant t<tv, which auxiliary voltage is about 50% of the input voltage U0 and is present at the capacitor Cs, comprises the second auxiliary transistor T12, the second coil L2 and the bridge transistor T1. The cell voltage Up continues to be zero because the capacitor Cp does not build up any capacitance.

FIG. 7 shows the position of the essential elements of the commutation circuit in accordance with the method according to the invention of controlling a circuit arrangement for the supply of AC voltage of a plasma display panel for an instant t>tv. The first bridge transistor T1 is now also shown as an open switch and is therefore currentless. The circuit thus comprises during the discharging for t>tv the capacitor Cs, which is shown here as a voltage source with 50% of the value of the input voltage Uh=U0/2, the second auxiliary transistor T12, the second coil L2 and the capacitor Cp.

FIG. 8 is a diagram showing the discharging current i2(t) and the cell voltage Up over time t. The current linearly rises with time t<tv. This is caused by the conducting switch T1 for t<tv. For t>tv the voltage drop is steeper than in the conventional method of controlling the commutation circuit because the discharging current i2(t) in the second coil L2 has already been partly built up. Since the capacitor Cp discharges as from t>tv, the voltage difference across the second coil L2 diminishes and thus also the rise of current. The discharging current i2 then according to the invention reaches a maximum current i2max which exceeds the maximum current in FIG. 2 of the prior art. As a result, during the sinusoidal half oscillation of the discharging current i2(t) the capacitor Cp is discharged to a lower voltage up(t).

FIG. 9 illustrates an example plasma display system. The controller is configured to control the switching of the transistors T1–T4, T11–T12 in the AC power supply to the plasma display panel as detailed above.

The diagrams in FIGS. 5 and 8 are shown in normalized fashion as is the diagram in FIG. 2. up(t) is then related to the input voltage U0 and the charging current i1(t) or discharging current i2(t), respectively, is related to the input voltage U0 divided by the impedance Z0, where Z0 is formed by:

$$Z0 = \sqrt{\frac{L0}{Cp}}$$

In an embodiment of the invention the delay time tv is fixedly set, for example, to ⅛ of the oscillatory period. The delay time tv is arranged such that the pre-charging of the coils L1, L2 is sufficiently large for the charging current I1 or discharging current I2, respectively to be allowed to rise to a value that exceeds the input voltage U0 divided by the impedance I0. The fixed setting may also be used in repetitive work. The MOSFET (Metal Oxide Semiconductor-Field Effect Transistor) switch used as an inner diode in this example of embodiment prevents a rise of the cell voltage Up beyond the input voltage U0.

In another embodiment of the invention the delay time tv is not fixedly set but is corrected automatically. As a measure for the correction the voltage difference Udiff between the cell voltage Up and the input voltage U0 i.e. Udiff=Up=U0 . . . . If the voltage difference at the instant when the bridge transistor T1 is turned on exceeds zero, the delay time tv for the next switching period is reduced. The voltage difference may become positive because the inner diode of the transistor will not become conductive until a small positive voltage is applied. If the voltage difference at the instant when the first bridge transistor T1 is turned on is smaller than zero, the delay time tv for the next switching period is extended. The sign of the differential voltage may preferably be determined by a voltage comparator.

The method according to the invention of controlling a circuit arrangement for the AC power supply of a plasma display panel leads to a substantially exact reaching of the voltage level of the cell voltage when the current in the respective coil is preset correctly.

The invention claimed is:

1. A method of controlling a circuit arrangement for an AC power supply of a plasma display panel in which the circuit arrangement includes at least a transistor bridge that includes bridge transistors T1, T2, T3, T4, an input voltage U0, a capacitor Cp of a plasma cell and a charging circuit in the form of an auxiliary voltage Uh, a first auxiliary transistor T11 and a first coil L1, the method comprising:

performing a chagring operation to charge capacitor Cp by:

controlling the first auxiliary transistor T11 as conductive at a beginning of the charging operation, controlling the bridge transistor T2 as conductive for a delay time tv, which is greater than zero, to inhibit charging of the capacitor Cp, and controlling the bridge transistor T2 non-conductive after the delay time tv has elapsed, to effect the charging of the capacitor Cp.

2. The method of claim 1, wherein the delay time tv is approximately ⅛ of the oscillatory period.

3. The method of claim 1, including generating the input voltage U0 from a DC voltage source.

4. The method of claim 1, in which the circuit arrangement further includes a discharging circuit that includes a second auxiliary transistor T12 and a second coil L2, the method comprising:

at a beginning of a discharging operation:

controlling the second auxiliary transistor T12 as conductive, and controlling the bridge transistor T1 as conductive for a delay time tv, which is greater than zero, to inhibit discharging of the capacitor Cp, and after the delay time tv has elapsed, controlling the bridge transistor T1 as non-conductive, to effect the discharging of the capacitor Cp.

5. The method of claim 1, including applying the auxiliary voltage Uh to an auxiliary capacitor Cs.

6. The method of claim 5, wherein a capacitance of the auxiliary capacitor Cs substantially exceeds a capacitance of the capacitor Cp of the plasma cell.

7. The method of claim 1, wherein the delay time tv is selected such that, at an end of the charging operation, a voltage of the capacitor Cp substantially equals the input voltage UO.

8. The method of claim 7, including controlling the delay time tv, based on a difference between the voltage of the capacitor and the input voltage UO at an end of a prior charging operation.

9. A method of controlling a circuit arrangement for an AC power supply of a plasma display panel, in which the circuit arrangement includes at least a transistor bridge that includes bridge transistors T1, T2, T3, T4, an input voltage UO, a capacitor Cp of a plasma cell and a discharging circuit comprising an auxiliary voltage Uh, a second auxiliary transistor T12 and a second coil L2, the method comprising:

at a beginning of a discharging operation:

controlling the second auxiliary transistor T12 as conductive, and controlling the bridge transistor T1 as conductive for a delay time tv, which is greater than zero, to inhibit discharging of the capacitor Cp, and after the delay time tv has elapsed, controlling the bridge transistor T1 as non-conductive, to effect the discharging of the capacitor Cp.

10. An apparatus comprising:

a circuit arrangement for supplying AC power to a plasma display panel, and a controller that is configured to control the circuit arrangement;

wherein:

the circuit arrangement includes:

a transistor bridge that includes bridge transistors T1, T2, T3, T4, that is coupled to a capacitor Cp of a plasma cell, and a charging circuit that includes:

an auxiliary voltage Uh, a first auxiliary transistor T11 and a first coil L1; and the controller is configured to:

control the first auxiliary transistor T11 as conductive at a beginning of a charging operation control the bridge transistor T2 as conductive for a delay time tv, which is greater than zero, to inhibit charging of the capacitor Cp, and control the bridge transistor T2 non-conductive after the delay time tv has elapsed, to effect the charging of the capacitor Cp.

11. The apparatus of claim 10, include a plasma display that includes the plasma cell.

12. A method of driving a plasma cell, comprising:

generating an oscillation signal via a resonant circuit, at a start of a charging period of the oscillation signal, providing a low impedance path for the resonant circuit, to increase a current that flows through an inductor of the resonant circuit, after a first delay period from the start of the charging period, removing the low impedance path, such that the current of the resonant circuit flows substantially to a capacitor of the plasma cell.

13. The method of claim 12, including:

at a start of a discharging period of the oscillation signal, providing a low impedance path for the resonant circuit, to increase a current that flows through an other inductor of the resonant circuit, after a second delay period from the start of the discharging period, removing the low impedance path, such that the current of the resonant circuit flows substantially from the capacitor of the plasma cell.

14. The method of claim 12, wherein the first delay period corresponds to approximately one-eighth of the charging period.

15. The method of claim 12, further including coupling the capacitor to a voltage source at an end of the charging period, wherein the first delay period is selected such that, at the end of the charging period, a voltage of the capacitor provide during the charging period substantially equals a voltage of the voltage source.

16. The method of claim 15, including controlling the first delay period based on a difference between the voltage of the capacitor and the voltage of the voltage source immediately before a prior coupling of the capacitor to the voltage source.

17. A method of driving a plasma cell, comprising:

generating an oscillation signal via a resonant circuit, at a start of a discharging period of the oscillation signal, providing a low impedance path for the resonant circuit, to increase a current that flows through an inductor of the resonant circuit, after a delay period from the start of the discharging period, removing the low impedance path, such that the current of the resonant circuit flows substantially from a capacitor of the plasma cell.

* * * * *